US008044883B2

(12) United States Patent
Jung et al.

(10) Patent No.: US 8,044,883 B2
(45) Date of Patent: Oct. 25, 2011

(54) METHOD OF DRIVING PLASMA DISPLAY APPARATUS WITH OVERLAPPING RESET PULSES AND A SECOND RAMP-DOWN PULSE

(75) Inventors: Kyoung Jin Jung, Gumi-si (KR); Ki Duck Cho, Changwon-si (KR); Sung Im Lee, Gumi-si (KR); Min Soo Kim, Gumi-si (KR)

(73) Assignee: LG Electronics Inc., Seoul (KR)

( * ) Notice: Subject to any disclaimer, the term of this patent is extended or adjusted under 35 U.S.C. 154(b) by 918 days.

(21) Appl. No.: 11/384,443

(22) Filed: Mar. 21, 2006

(65) Prior Publication Data

US 2006/0214882 A1 Sep. 28, 2006

(30) Foreign Application Priority Data

Mar. 22, 2005 (KR) ..... 10-2005-0023853

(51) Int. Cl.
*G09G 3/28* (2006.01)

(52) U.S. Cl. ..... 345/60

(58) Field of Classification Search ..... 345/204, 345/600, 60–67

See application file for complete search history.

(56) References Cited

U.S. PATENT DOCUMENTS 4,924,218 A * 5/1990 Weber et al. ..... 345/67
6,473,061 B1 * 10/2002 Lim et al. ..... 345/60
2002/0018056 A1 * 2/2002 Ozawa et al. ..... 345/204
2002/0030643 A1 * 3/2002 Sasaki et al. ..... 345/60
2003/0006945 A1 * 1/2003 Lim et al. ..... 345/67
2003/0122742 A1 * 7/2003 Akiba ..... 345/63
2003/0189533 A1 * 10/2003 Myoung et al. ..... 345/67
2003/0197474 A1 * 10/2003 Kang et al. ..... 315/169.4
2003/0218579 A1 * 11/2003 Uemura et al. ..... 345/60
2004/0212560 A1 * 10/2004 Son et al. ..... 345/60
2004/0239588 A1 * 12/2004 Nagao et al. ..... 345/60
2004/0251830 A1 * 12/2004 Nagao et al. ..... 313/582
2005/0017962 A1 * 1/2005 Sakata et al. ..... 345/204
2005/0024296 A1 * 2/2005 Nakamura et al. ..... 345/60
2005/0057443 A1 3/2005 Whang et al. ..... 345/60
2005/0073482 A1 * 4/2005 Kim et al. ..... 345/60
2005/0156821 A1 * 7/2005 Hashimoto et al. ..... 345/60
2005/0264230 A1 * 12/2005 Kim et al. ..... 315/169.4

FOREIGN PATENT DOCUMENTS

EP 1 555 645 A2 7/2005
EP 1555645 A2 * 7/2005
JP 05-119738 5/1993

OTHER PUBLICATIONS

JP-05-119738-A Machine Translation.*
Chinese Office Action dated Jul. 4, 2008.

* cited by examiner

*Primary Examiner* — Alexander Eisen
*Assistant Examiner* — Liliana Cerullo
(74) *Attorney, Agent, or Firm* — KED & Associates, LLP

(57) ABSTRACT

A method of driving a plasma display apparatus is provided. The method of driving the plasma display apparatus includes applying a first pulse to a first electrode, applying a second pulse to a second electrode after the application of the first pulse, and applying a falling ramp pulse to the first electrode after the application of the second pulse.

20 Claims, 9 Drawing Sheets

METHOD OF DRIVING PLASMA DISPLAY APPARATUS WITH OVERLAPPING RESET PULSES AND A SECOND RAMP-DOWN PULSE

This Nonprovisional application claims priority under 35 U.S.C. §119(a) on Patent Application No. 10-2005-0023853 filed in Korea on 22 Mar. 2005 the entire contents of which are hereby incorporated by reference.

BACKGROUND OF THE INVENTION

1. Field of the Invention

This document relates to a method of driving a plasma display apparatus.

2. Description of the Related Art

A plasma display apparatus displays an image including a character or a graphic design by light-emitting a phosphor through ultraviolet rays generated by discharging an inert gas mixture such as a He—Xe gas mixture, a Ne—Xe gas mixture or a He—Xe—Ne gas mixture. The plasma display apparatus can be manufactured to be thin and large while providing an improved image quality. Since a three-electrode AC surface-discharge type plasma display apparatus protects electrodes from sputtering on discharging, it has an advantage of the low-voltage driving and the long life span.

A plasma display apparatus is driven by dividing a frame into several subfields, where number of light-emissions of each of the subfields are different from one another, so as to represent gray scale of an image. Each of the subfields comprises a reset period for initializing all of cells, an address period for selecting a scan line and cells to be discharged, and a sustain period for representing gray scale depending on number of light-emissions of each of the subfields.

SUMMARY OF THE INVENTION

Accordingly, an object of the present invention is to solve at least the problems and disadvantages of the background art.

According to an aspect of the present invention, there is provided a method of driving a plasma display apparatus comprising applying a first pulse to a first electrode, applying a second pulse to a second electrode after the application of the first pulse, and applying a falling ramp pulse to the first electrode after the application of the second pulse.

According to another aspect of the present invention, there is provided a method of driving a plasma display apparatus comprising applying a sustain pulse to a first electrode, applying a first pulse of the width less than the width of the sustain pulse to a second electrode, and applying a second pulse of the width less than the width of the Sustain pulse to the first electrode after the application of the first pulse.

According to still another aspect of the present invention, there is provided a method of driving a plasma display apparatus comprising applying a first pulse to a first electrode, and applying a second pulse to a second electrode after the passage of 0.1 μs to 2 μs from an application time point of the first pulse, wherein the first pulse and the second pulse overlap.

BRIEF DESCRIPTION OF THE DRAWINGS

The embodiment of the invention will be described in detail with reference to the following drawings in which like numerals refer to like elements.

DETAILED DESCRIPTION OF PREFERRED EMBODIMENTS

Figure 1:
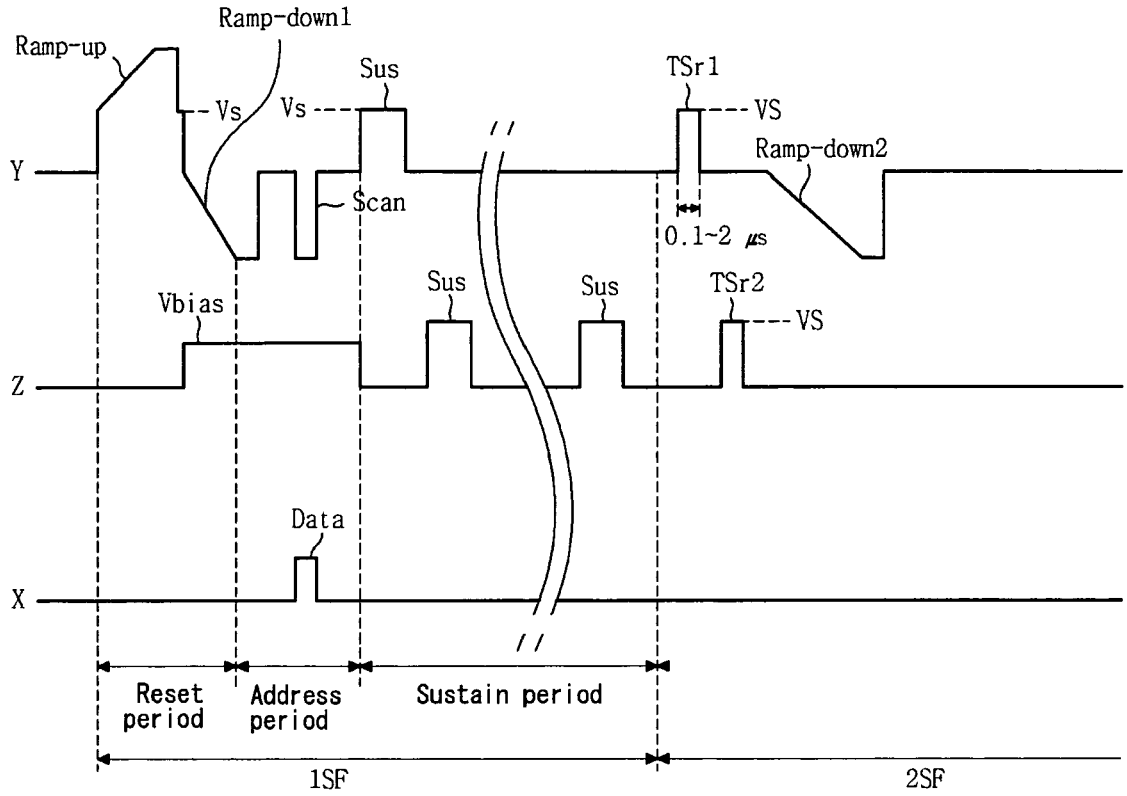
FIG. 1 illustrates a method of driving a plasma display apparatus according to a first embodiment of the present invention.

Embodiments of the present invention will be described in a more detailed manner with reference to the attached drawings.

A method of driving a plasma display apparatus according to embodiments of the present invention comprises applying a first pulse to a first electrode, applying a second pulse to a second electrode after the application of the first pulse, and applying a falling ramp pulse to the first electrode after the application of the second pulse.

The first pulse and the second pulse may overlap in some portion of the duration of time of the first pulse and the second pulse.

A total period may equal the duration of time from an application start time point of the first pulse to an application finish time point of the second pulse. The total period may comprise a first period, a second period and a third period. The first period may equal the duration of time when the first pulse and the second pulse do not overlap. The second period which follows the first period, may equal the duration of time when the first pulse and the second pulse overlap. The third period which follows the second period, may equal the duration of time when the first pulse and the second pulse do not overlap.

The width of the first pulse may range from 0.1 μs to 2 μs.

The duration of the first period may range from 0.1 μs to 2 μs.

The duration of the first period may be substantially equal to the duration of the third period.

The application of a last sustain pulse to the second electrode may occur before the application of the first pulse. Magnitudes of the peak voltages of the last sustain pulse, the first pulse and the second pulse may be equal to one another.

Each of the first pulse and the second pulse may be applied two or more times.

A method of driving a plasma display apparatus according to the embodiments of the present invention comprises applying a sustain pulse to a first electrode, applying a first pulse of the width less than the width of the sustain pulse to a second electrode, and applying a second pulse of the width less than the width of the sustain pulse to the first electrode after the application of the first pulse.

The first pulse and the second pulse may overlap in some portion of the duration of time of the first pulse and the second pulse.

The method of driving the plasma display apparatus may further comprise applying a falling ramp pulse to the second electrode after the application of the second pulse.

The width of the first pulse may be substantially equal to the width of the second pulse.

The width of the first pulse or the second pulse may range from 0.1 μs to 2 μs.

The polarities of the peak voltages of the sustain pulse, the first pulse and the second pulse may be equal to one another.

The magnitudes of the peak voltages of the sustain pulse, the first pulse and the second pulse may be equal to one another.

A method of driving a plasma display apparatus according to the embodiments of the present invention comprises applying a first pulse to a first electrode, and applying a second pulse to a second electrode after the passage of 0.1 μs to 2 μs from an application time point of the first pulse, wherein the first pulse and the second pulse overlap.

A total period may equal the duration of time from an application start time point of the first pulse to an application finish time point of the second pulse. The total period may comprise a first period, a second period and a third period. The first period may equal the duration of time when the first pulse and the second pulse do not overlap. The second period which follows the first period, may equal the duration of time when the first pulse and the second pulse overlap. The third period which follows the second period, may equal the duration of time when the first pulse and the second pulse do not overlap.

The duration of the first period may be substantially equal to the duration of the third period.

The application of a last sustain pulse to the second electrode may occur before the application of the first pulse. The polarities of the peak voltages of the last sustain pulse, the first pulse and the second pulse may be equal to one another.

The application of the last sustain pulse to the second electrode may occur before the application of the first pulse. The magnitudes of the peak voltages of the last sustain pulse, the first pulse and the second pulse may be equal to one another.

Hereinafter, exemplary embodiments of the present invention will be described in detail with reference to the attached drawings.

First Embodiment

FIG. 1 illustrates a method of driving a plasma display apparatus according to a first embodiment of the present invention. As shown in FIG. 1, the method of driving the plasma display apparatus according to the first embodiment of the present invention comprises applying a first pulse such as a first selective reset pulse TSr1 to a first electrode such as a scan electrode Y, applying a second pulse such as a second selective reset pulse TSr2 to a second electrode such as a sustain electrode Z after the application of the first selective reset pulse TSr1, and applying a falling ramp pulse Ramp-down2 to the first electrode after the application of the second selective reset pulse TSr2.

During a setup period of a reset period of a first subfield 1SF of one frame, a rising ramp pulse Ramp-up is simultaneously applied to all of the scan electrodes Y. A weak setup discharge is generated within the whole cells of the plasma display apparatus by the rising ramp pulse Ramp-up, thereby producing wall charges within the cells.

After the application of the rising ramp pulse Ramp-up, a first falling ramp pulse Ramp-down1 falling from a sustain voltage Vs lower than a peak voltage of the rising ramp pulse Ramp-up is simultaneously applied to the scan electrodes Y during a set-down period of the reset period. The first falling ramp pulse Ramp-down1 generates a weak erasure discharge within the cells. The weak erase discharge erases unnecessary charges of the wall charges and space chargers produced by performing the setup discharge, thereby uniformly remaining the wall charges.

In an address period, a negative scan pulse Scan is sequentially applied to the scan electrodes Y, and at the same time, a positive data pulse Data synchronized with the negative scan pulse Scan is applied to address electrodes X. While the voltage difference between the negative scan pulse Scan and the positive data pulse Data is added to a wall voltage produced during the reset period, an address discharge is generated within the cells to which the data pulse Data is applied.

During the duration of time from an application start time point of the first falling ramp pulse Ramp-down1 to the scan electrodes Y to a finish time point of the address period, a positive bias voltage Vbias is applied to the sustain electrodes Z.

In a sustain period, a sustain pulse Sus is alternately supplied to the scan electrodes Y and the sustain electrodes Z. Whenever the sustain pulse Sus is applied to the cells selected by performing the address discharge, a sustain discharge is generated by a surface discharge generated between the scan electrodes Y and the sustain electrodes Z. As shown in FIG. 1, in the method of driving the plasma display apparatus according to the first embodiment of the present invention, a last sustain pulse Sus is applied to the sustain electrodes Z.

In a second subfield 2SF, the first selective reset pulse TSr1 is applied to the scan electrodes Y being an electrode, to which the last sustain pulse Sus is not applied in the first subfield 1SF. The maximum voltage value of the first selective reset pulse TSr1 is equal to the sustain voltage Vs. After the application of the first selective reset pulse TSr1 to the scan electrode Y, the second selective reset pulse TSr2 is applied to the sustain electrode Z.

The widths of the first selective reset pulse TSr1 and the second selective reset pulse TSr2 are less than the width of the sustain pulse Sus. The width of the first selective reset pulse TSr1 or the second selective reset pulse TSr2 applied to the scan electrode Y and the sustain electrode Z ranges from 0.1 μs to 2 μs. Polarities of the first selective reset pulse TSr1, the second selective reset pulse TSr2 and the sustain pulse Sus are equal to one another.

The production of the wall charges is controlled by the discharge generated between the scan electrode Y and the sustain electrode Z by the first selective reset pulse TSr1 and the second selective reset pulse TSr2. A discharge principle by a driving waveform of the plasma display apparatus according to the first embodiment of the present invention will be described in detail using a voltage close curve shown in FIGS. 2 through 7.

Figure 2:
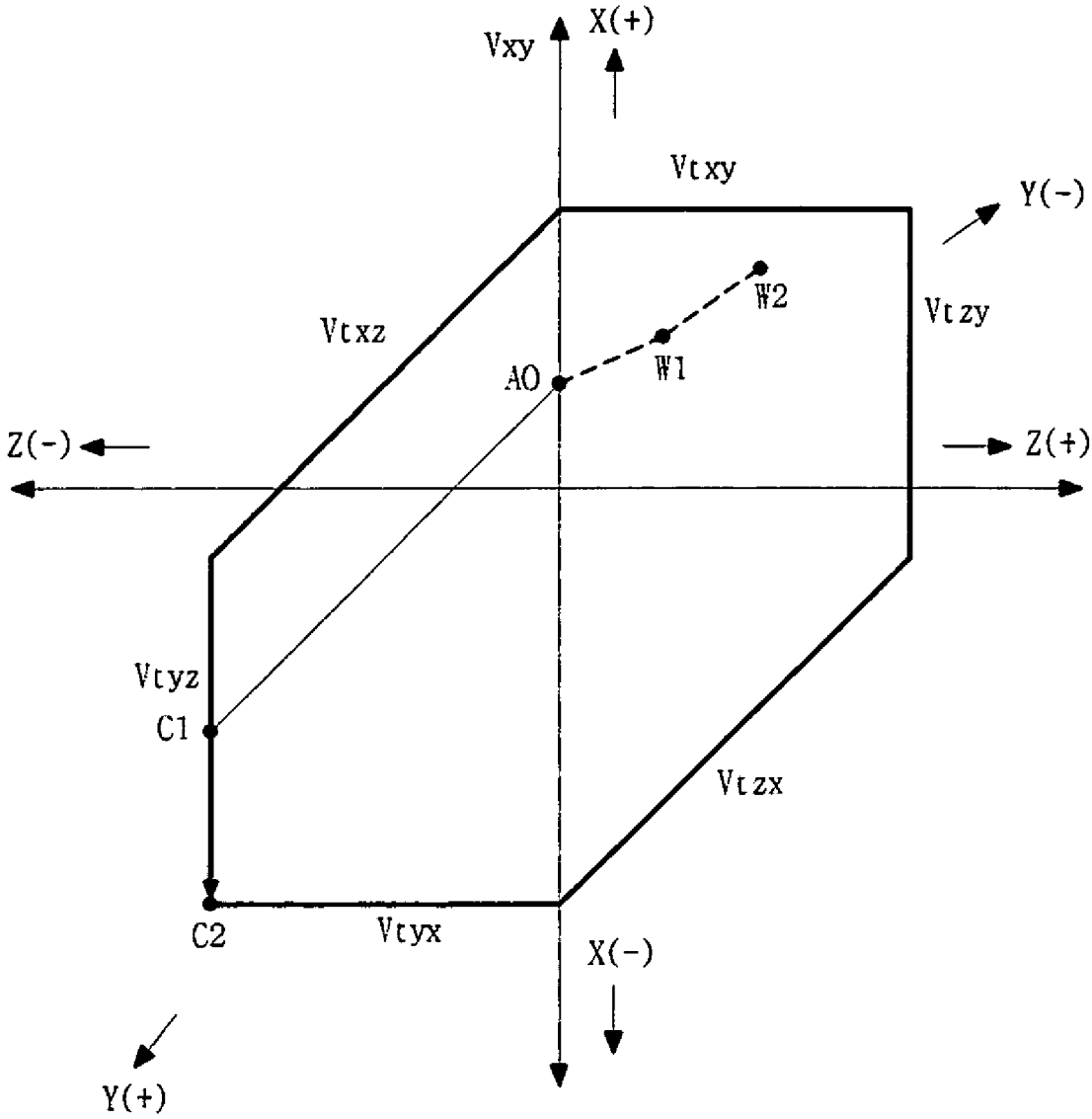
FIG. 2 illustrates a change in cell voltages and a change in wall voltages caused by a rising ramp pulse supplied in a first subfield in the method of driving the plasma display apparatus according to the first embodiment of the present invention.

FIG. 2 illustrates a change in cell voltages and a change in wall voltages caused by the rising ramp pulse supplied in the first subfield in the method of driving the plasma display apparatus according to the first embodiment of the present invention.

A voltage close curve is used to explain a discharge generation principle and measure a voltage margin of the plasma display apparatus. A horizontal axis and a vertical axis of the voltage close curve denote the voltage difference between the scan electrode Y and the sustain electrode Z and the voltage difference between the scan electrode Y and the address electrode X, respectively. A straight line parallel to the vertical axis denotes a discharge start voltage between the scan electrode Y and the sustain electrode Z. A straight line parallel to the horizontal axis denotes a discharge start voltage between the scan electrode Y and the address electrode X. A straight line whose a slope is 1 in quadrants II and IV denotes a discharge start voltage between the sustain electrode Z and the address electrode X.

A hexagon formed by the voltage close curve denotes a region where a voltage condition of the cell is less than the discharge start voltage. For example, when a cell voltage is located in an internal region of the hexagon, no discharge is generated. When a cell voltage is located in an external region of the hexagon, a discharge is generated. In other words, the internal region of the voltage close curve is a non-discharge region where no discharge is generated within the discharge cell, and the external region of the voltage close curve is a discharge region where a discharge is generated within the discharge cell.

Here, Y(−) denotes a movement direction of the cell voltage when supplying a negative voltage to the scan electrode Y. In the same way as Y(−), Y(+), X(+), X(−), Z(+) and Z(−) denote a movement direction of the cell voltage when supplying a negative voltage or a positive voltage to the scan electrode Y, the address electrode X and the sustain electrode Z, respectively.

Thus, Vtxy indicated in an opposite discharge region in a quadrant I of a graph of the voltage close curve denotes a discharge start voltage between the address electrode X and the scan electrode Y when supplying a voltage to the address electrode X. The length of a straight line indicating the opposite discharge region in the quadrant I of the voltage close curve graph corresponds to the discharge start voltage between the address electrode X and the scan electrode Y.

Vtzy indicated in a surface discharge region in the quadrant I of the voltage close curve graph denotes a discharge start voltage between the sustain electrode Z and the scan electrode Y when supplying a voltage to the sustain electrode Z. In the same way as Vtzy, Vtxz, Vtzx, Vtyz and Vtyx denote a discharge start voltage between the electrodes, respectively. Since a value of a voltage such as Vtxy, Vtzy, Vtxz, Vtzx, Vtyz and Vtyx slightly changes in all of plasma display apparatuses, a shape of the voltage close curve slightly changes in all of the plasma display apparatuses.

Referring to FIG. 2, conditions of wall charges within each of discharge cells in the first subfield of one frame is not uniform. To uniform the conditions of the wall charges within each of the discharge cells, the rising ramp pulse Ramp-up of FIG. 1, which gradually rises from a positive voltage to a voltage equal to or more than the discharge start voltage, is supplied to the scan electrode Y during the setup period of the first subfield. Thus, by supplying the rising ramp pulse Ramp-up to the scan electrode Y, a discharge is generated in a discharge boundary region between the scan electrode Y and the sustain electrode Z even in the cells of different wall voltage conditions.

A wall voltage generated by the wall charges accumulated on the scan electrode Y and the sustain electrode Z moves from a point A0 to a point W1. The point A0 denotes an initial wall voltage between the scan electrode Y and the sustain electrode Z. After the start of the discharge generation, an external supply voltage continually increases by the rising ramp pulse Ramp-up of FIG. 1. However, the discharge generated by the rising ramp pulse Ramp-up forms wall charges, and the formed wall charges generate a voltage of an opposite polarity of a polarity of the external supply voltage. As a result, the cell voltage increases to a voltage less than the discharge start voltage.

Since the external supply voltage continually increases, the opposite discharge is generated at a point C2 corresponding to the discharge start voltage between the scan electrode Y and the sustain electrode Z. As a result, the surface discharge and the opposite discharge are simultaneously generated. Since the cell voltage in the opposite discharge does not change by the formation of the wall charges, the cell voltage stays at the point C2. Since the opposite discharge is generated from the moment the cell voltage reaches the point C2, the wall charges are produced between the scan electrode Y and the address electrode X. Further, a change in the voltage difference between the scan electrode Y and the sustain electrode Z is equal to a change in the voltage difference between the scan electrode Y and the address electrode X. As a result, the wall voltage changes from the point W1 to a point W2.

Figure 3:
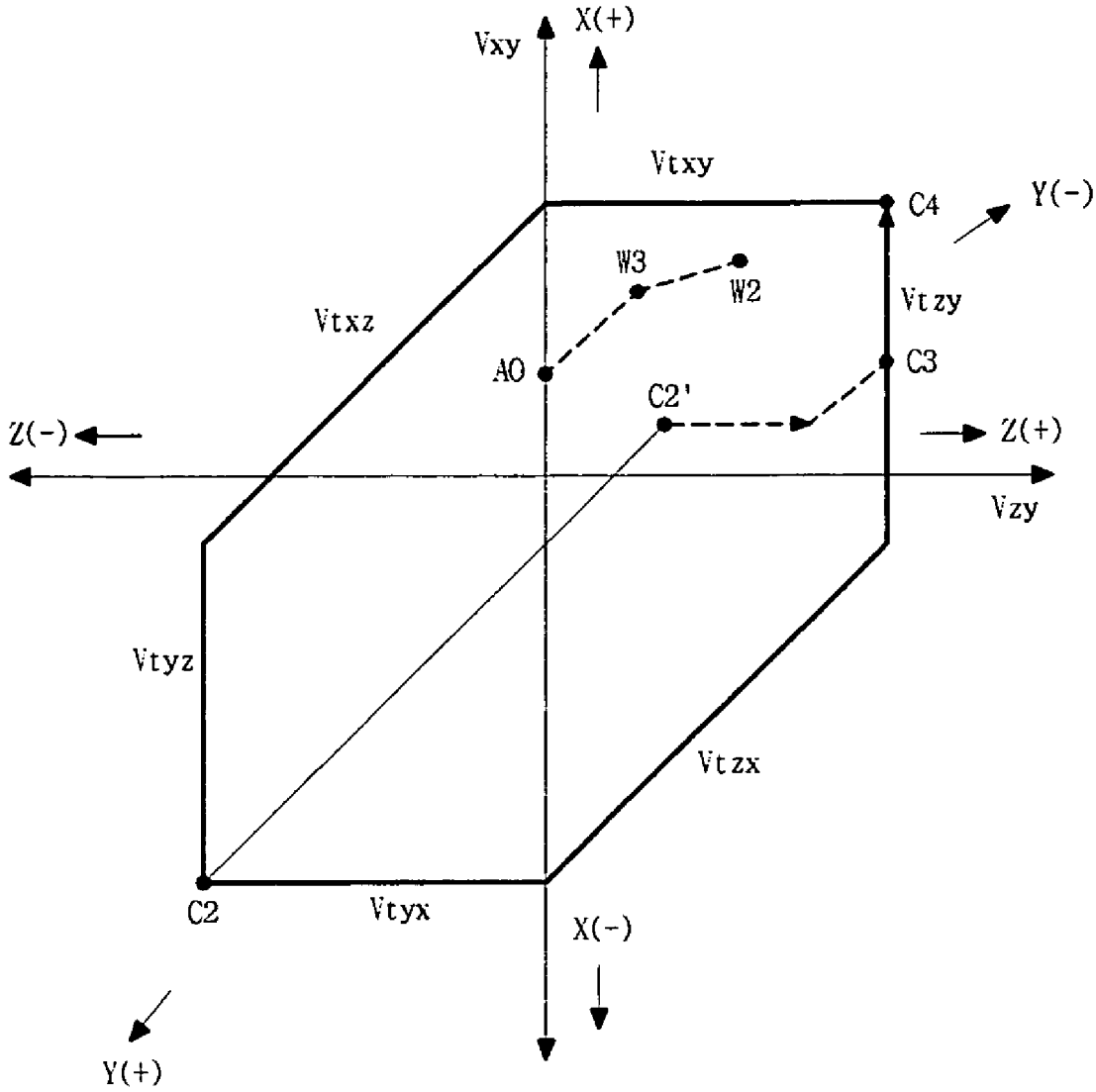
FIG. 3 illustrates a change in cell voltages and a change in wall voltages caused by a falling ramp pulse supplied in the first subfield in the method of driving the plasma display apparatus according to the first embodiment of the present invention.

FIG. 3 illustrates a change in cell voltages and a change in wall voltages caused by the falling ramp pulse supplied in the first subfield in the method of driving the plasma display apparatus according to the first embodiment of the present invention.

The moment the first falling ramp pulse Ramp-down1, which follows the rising ramp pulse Ramp-up of FIG. 1, is supplied the external supply voltage falls from the maximum value of the rising ramp pulse Ramp-up to a ground level voltage. That is, since the external supply voltage changes in a direction Y(−) of the supply of a negative voltage to the scan electrode Y, the cell voltage, as shown in FIG. 3, changes in the direction Y(−) and then the position of the cell voltage changes to a point C2' just before the supply of the first falling ramp pulse Ramp-down1. During the set-down period, the first falling ramp pulse Ramp-down1 in which a voltage value gradually falls, is supplied to the scan electrode Y, and the bias voltage Vbias of FIG. 1 is supplied to the sustain electrode Z.

The bias voltage Vbias supplied to the sustain electrode Z causes the cell voltage to change from the point C2' to a direction Z(+). The first falling ramp pulse Ramp-down1 of FIG. 1 causes the cell voltage to change to a direction Y(−). The surface discharge is generated at a point of time when the cell voltage reaches a point C3.

Since the wall charges are formed from the moment the generation of the surface discharge, the wall voltage changes. Since the wall charges are formed only between the scan electrode Y and the sustain electrode Z, the voltage difference between the scan electrode Y and the sustain electrode Z is two times the voltage difference between the scan electrode Y and the address electrode X. The wall voltage changes from the point W2 to a point W3.

Even if the discharge is generated by the first falling ramp pulse Ramp-down1, the external supply voltage continually falls but the voltage difference between the scan electrode Y and the sustain electrode Z is less than the discharge start voltage. When the voltage difference between the scan electrode Y and the address electrode X reaches the discharge start voltage by the first falling ramp pulse Ramp-down1, which continually falls, the opposite discharge is generated. Although the opposite discharge is generated, the cell voltage is within the range of the voltage close curve.

Since the wall charges are accumulated on the address electrode X by the opposite discharge, the voltage difference between the scan electrode Y and the sustain electrode Z is equal to the voltage difference between the scan electrode Y and the address electrode X. Thus, the wall voltage changes from the point W3 to the point A0 and a slope of a straight line connecting from the point W3 to the point A0 is 1. That is, the wall voltage corresponds to the point A0 by the rising ramp pulse Ramp-up and the first falling ramp pulse Ramp-down1 supplied in the reset period, and thus the wall charge condition of each of the cells is initialized.

Figure 4:
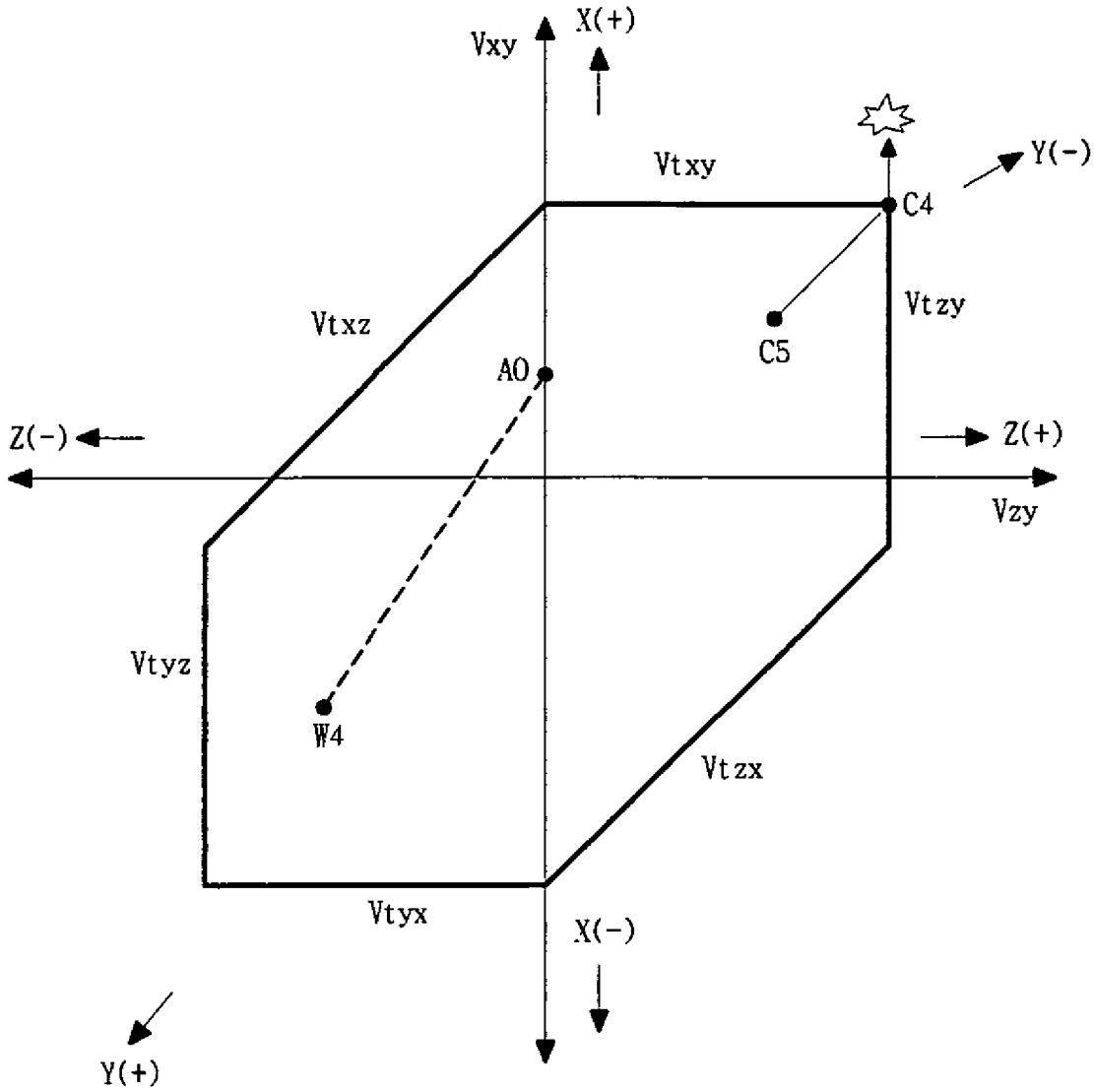
FIG. 4 illustrates a change in cell voltages and a change in wall voltages in an address period of the first subfield in the method of driving the plasma display apparatus according to the first embodiment of the present invention.

FIG. 4 illustrates a change in cell voltages and a change in wall voltages in the address period of the first subfield in the method of driving the plasma display apparatus according to the first embodiment of the present invention.

A ground level voltage, which follows the first falling ramp pulse Ramp-down1 of FIG. 1, is supplied to the scan electrode Y during an initial period of the address period. Since the negative first falling ramp pulse Ramp-down1 and the ground level voltage are successively supplied to the scan electrode Y, the cell voltage, as shown in FIG. 4, changes to a point C5 toward a direction Y(+).

The negative scan pulse Scan of FIG. 1 is supplied to the scan electrode Y, and at the same time, the positive data pulse Data is supplied to the address electrode X. The cell voltage changes to the point C4 by the scan pulse. A cell voltage of a cell, to which the data pulse Data is supplied, is beyond Vtxy corresponding to the discharge start voltage, and thus the opposite discharge is generated between the scan electrode Y and the address electrode X. By performing the opposite discharge, wall charges are formed on the scan electrode Y and the address electrode X.

Accordingly, since the voltage difference between the scan electrode Y and the address electrode X is two times the voltage difference between the scan electrode Y and the sustain electrode Z, the wall voltage changes from the point A0 to the point W4 and a slope of a straight line connecting from the point A0 to the point W4 is 2.

During the sustain period which follows the address period, the sustain pulse is alternately supplied to the scan electrode Y and the sustain electrode Z.

Figure 5:
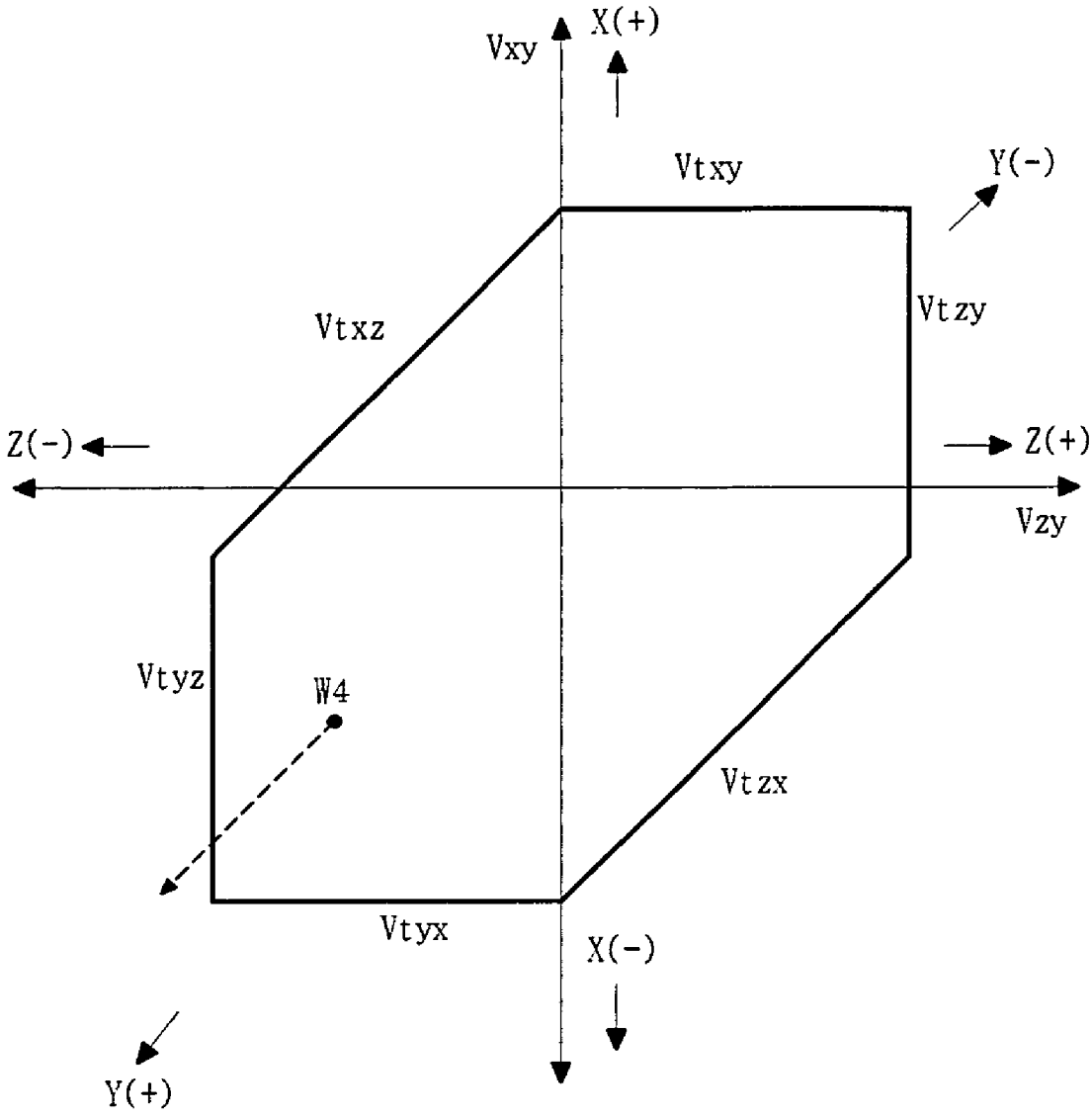
FIG. 5 illustrates a change in cell voltages and a change in wall voltages caused by a sustain pulse supplied to a scan electrode in the first subfield in the method of driving the plasma display apparatus according to the first embodiment of the present invention.
Figure 6:
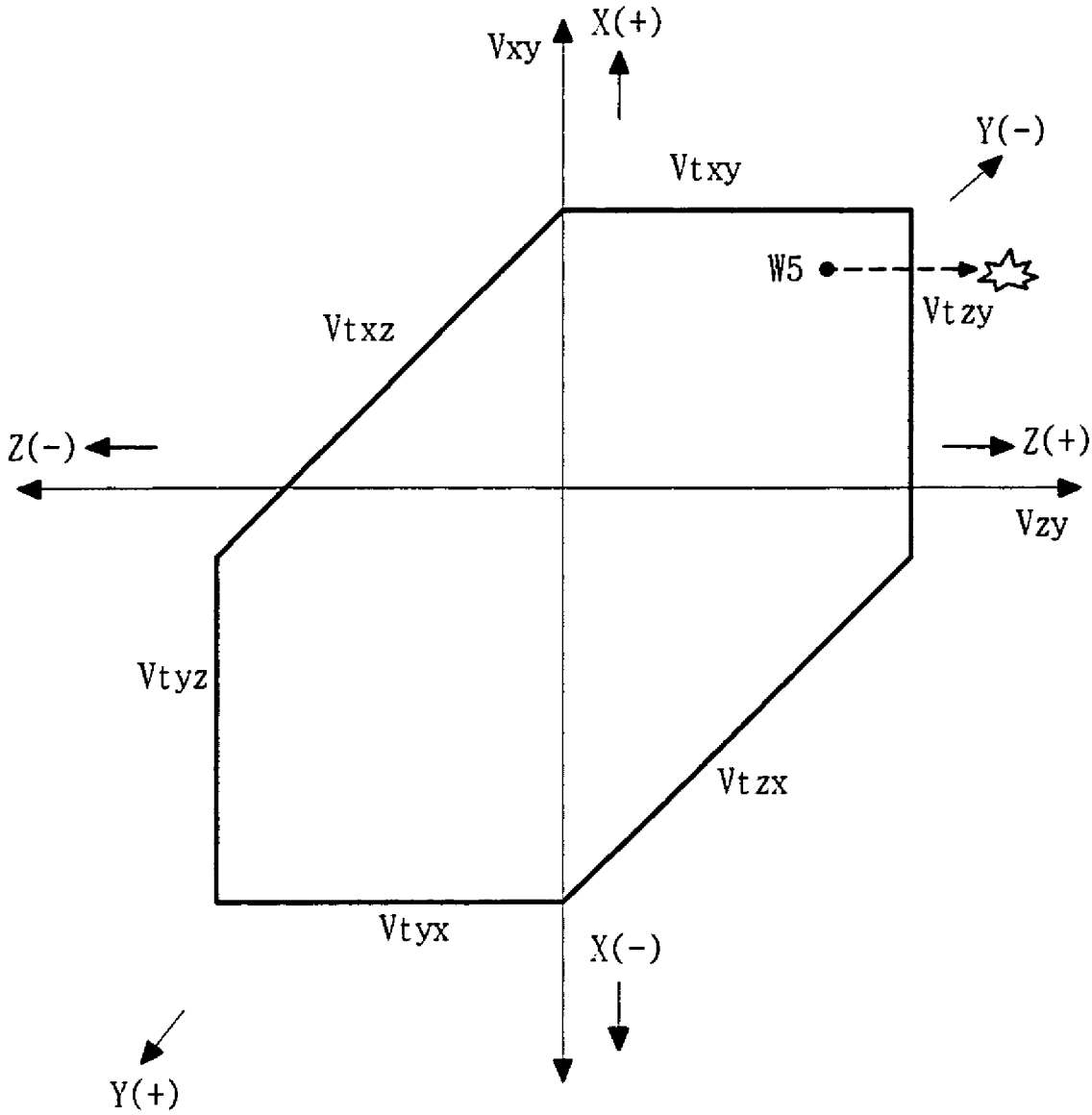
FIG. 6 illustrates a change in cell voltages and a change in wall voltages caused by a sustain pulse supplied to a sustain electrode in the first subfield in the method of driving the plasma display apparatus according to the first embodiment of the present invention.

FIG. 5 illustrates a change in cell voltages and a change in wall voltages caused by the sustain pulse supplied to the scan electrode in the first subfield in the method of driving the plasma display apparatus according to the first embodiment of the present invention;

As shown in FIG. 5, the sustain pulse Sus of FIG. 1 supplied to the scan electrode Y causes the cell voltage to change from the point W4 to a direction Y(+). As the sustain pulse Sus being a square wave is supplied, the sum of the wall voltage and the external supply voltage is beyond the discharge start voltage. Thus, a strong surface discharge is generated. A polarity of the wall charges formed on the scan electrode Y and a polarity of the wall charges formed on the sustain electrode Z are reversed by the strong surface discharge generated by the sustain pulse Sus, respectively. As shown in FIG. 6, the wall voltage changes to a point W5.

FIG. 6 illustrates a change in cell voltages and a change in wall voltages caused by the sustain pulse supplied to the sustain electrode in the first subfield in the method of driving the plasma display apparatus according to the first embodiment of the present invention.

When the sustain pulse Sus is supplied to the sustain electrode Z on the wall charge condition that the cell voltage is located at the point W5, as shown in FIG. 6, the cell voltage moves in a direction Z(+) and is equal to or more than the surface discharge start voltage. Thus, the surface discharge is generated and the polarity of the wall charges is reversed.

When the last sustain pulse is supplied to the sustain electrode Z after repeating the above-described processes, the wall voltage is located at the point W4.

Figure 7:
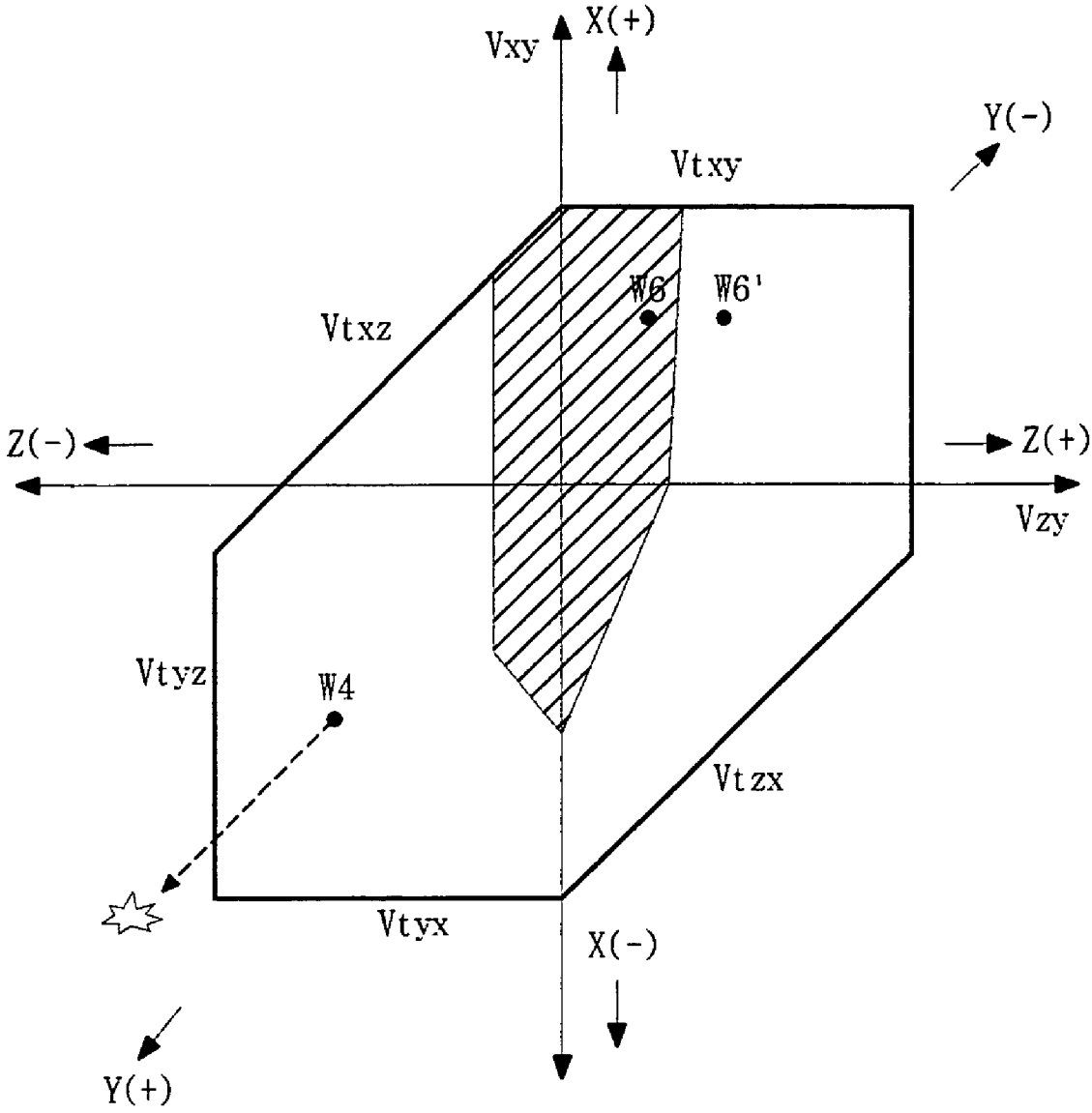
FIG. 7 illustrates a change in cell voltages and a change in wall voltages caused by a selective reset pulse supplied in a second subfield in the method of driving the plasma display apparatus according to the first embodiment of the present invention.

FIG. 7 illustrates a change in cell voltages and a change in wall voltages caused by a selective reset pulse supplied in the second subfield in the method of driving the plasma display apparatus according to the first embodiment of the present invention.

As shown in FIG. 1, the first selective reset pulse TSr1 is supplied to the scan electrode Y, to which the last sustain pulse is not supplied, in an initial period of the second subfield 2SF. The maximum voltage value of the first selective reset pulse TSr1 is equal to the sustain voltage value Vs. When the sum of the wall voltage generated by the supply of the first selective reset pulse TSr1 and the sustain voltage Vs is beyond the discharge start voltage, the surface discharge is generated. At this time, since the duration of time of the supply of the first selective reset pulse TSr1 is shorter than the duration of time of the supply of the sustain pulse, a small amount of wall charges is formed during the supply of the first selective reset pulse TSr1. The wall voltage condition generated by the first selective reset pulse TSr1 exists inside an initialization region indicated by oblique lines, that is, is located at a point W6 shown in FIG. 7.

However, in some cases, a large amount of wall charges may be formed. At this time, the wall voltage condition may exist outside the initialization region, that is, may be located at a point W6' shown in FIG. 7. In the discharge cell whose the wall charge condition is located outside the initialization region, a discharge is generated by the second selective reset pulse TSr2 supplied to the sustain electrode Z, which follows the first selective reset pulse TSr1 supplied to the scan electrode Y. When supplying the second selective reset pulse TSr2 to the sustain electrode Z, the discharge is generated in the cell whose the wall charge condition is located at the point W6'.

Since the discharge generated by the second selective reset pulse TSr2 is a weak discharge, the amount of the wall charges decreases. Thus, the wall charge condition is located inside the initialization region. That is, the wall charge condition may be located inside the initialization region by the first and second selective reset pulses TSr1 and TSr2 supplied to the scan electrode Y and the sustain electrode Z. When supplying the first and second selective reset pulses TSr1 and TSr2, the discharge is generated in only the cells where the sustain discharge is generated in the sustain period of the first subfield 1SF. Thus, high contrast ratio is realized by reducing unnecessary quantity of light generated by the discharge in an initialization period of the second subfield 2SF.

In particular, since the maximum voltage values of the first and second selective reset pulses TSr1 and TSr2 are equal to the sustain voltage Vs, an addition voltage supply source is not necessary. Accordingly, the manufacturing cost decreases.

The second falling ramp pulse Ramp-down2 which follows the second selective reset pulse TSr2, is supplied to the scan electrode Y. Since a discharge principle and a voltage condition during the supply of the second falling ramp pulse Ramp-down2, the address period and the sustain period which follows the supply of the second falling ramp pulse Ramp-down2, are substantially same as those in the first subfield 1SF, a description thereof is omitted.

In the first embodiment of the present invention, the last sustain pulse is supplied to the sustain electrode Z. However, the last sustain pulse may be supplied to the scan electrode Y. When the last sustain pulse is supplied to the scan electrode Y, the first selective reset pulse is supplied to the sustain electrode Z before the supply of the first selective reset pulse to the scan electrode Y. Then, the second selective reset pulse is supplied to the scan electrode Y.

Second Embodiment

Figure 8:
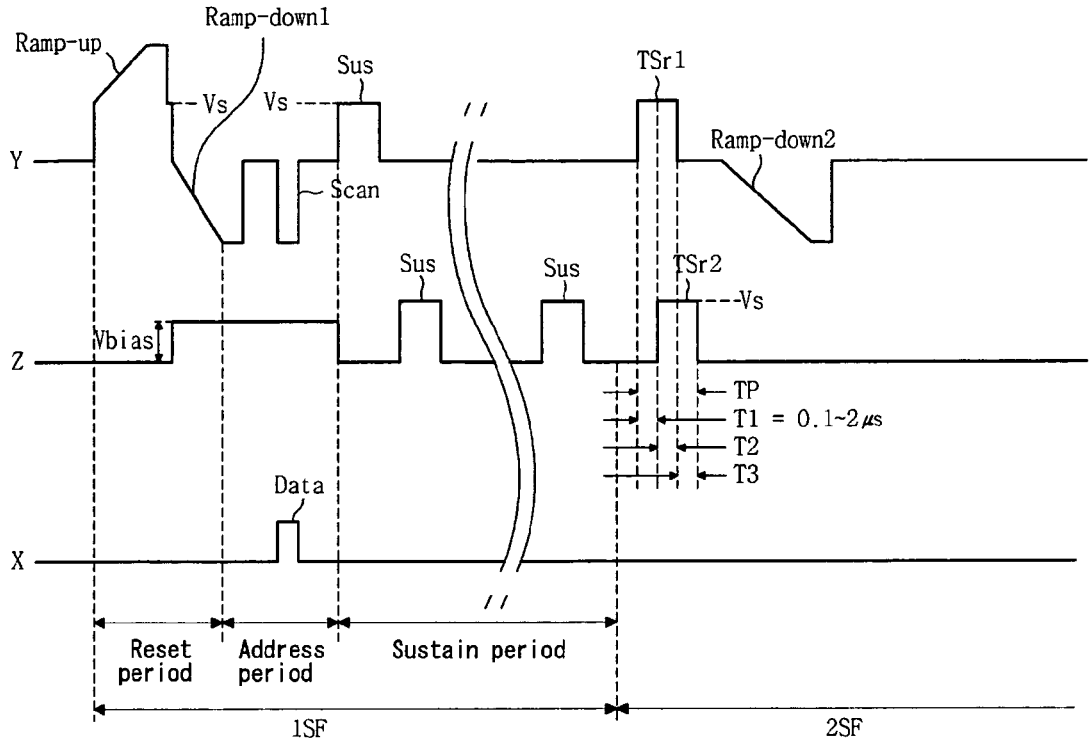
FIG. 8 illustrates a method of driving a plasma display apparatus according to a second embodiment of the present invention.

FIG. 8 illustrates a method of driving a plasma display apparatus according to a second embodiment of the present invention. As shown in FIG. 8, the method of driving the plasma display apparatus according to the second embodiment of the present invention comprises applying a first pulse such as a first selective reset pulse TSr1 to a first electrode such as a scan electrode Y, applying a second pulse such as a second selective reset pulse TSr2 to a second electrode such as a sustain electrode Z after the application of the first selective reset pulse TSr1, and applying a falling ramp pulse Ramp-down2 to the first electrode after the application of the second selective reset pulse TSr2.

A total period TP equals the duration of time from an application start time point of a first selective reset pulse TSr1 to an application finish time point of a second selective reset pulse TSr2. The total period TP comprises a first period T1, a second period T2 and a third period T3. The first period T1 equals the duration of time when the first selective reset pulse TSr1 and the second selective reset pulse TSr2 do not overlap. The second period T2 which follows the first period T1, equals the duration of time when the first selective reset pulse TSr1 and the second selective reset pulse TSr2 overlap. The third period T3 which follows the second period T2, equals the duration of time when the first selective reset pulse TSr1 and the second selective reset pulse TSr2 do not overlap. The duration of the first period T1 or the third period T3 ranges from 0.1 μs to 2 μs. The duration of the first period T1 is substantially equal to the duration of the third period T3. Polarities of the first selective reset pulse TSr1, the second selective reset pulse TSr2 and a sustain pulse Sus are equal to one another.

An operation in a reset period, an address period and a sustain period of a first subfield 1SF in a driving waveform according to the second embodiment of the present invention is substantially the same as the first embodiment.

Thus, a wall voltage of discharge cells where a sustain discharge is generated in the first subfield 1SF, is located at a point W4 of FIG. 6.

The first selective reset pulse TSr1 is supplied to the scan electrode Y in an initial period of the second subfield 2SF. A maximum voltage values of the first selective reset pulse TSr1 is equal to a sustain voltage Vs.

After the supply of the first selective reset pulse TSr1, the second selective reset pulse TSr2 is supplied to the sustain electrode Z. The first selective reset pulse TSr1 and the second selective reset pulse TSr2 overlap in the second period T2.

When the duration of the first period T1 ranges from 0.1 μs to 2 μs, the discharge generated by the first selective reset pulse TSr1 of the second embodiment is the same as the discharge generated by the first selective reset pulse TSr1 of the first embodiment.

When the first selective reset pulse TSr1 and the second selective reset pulse TSr2 overlap, a switching margin for generating the first selective reset pulse TSr1 and the second selective reset pulse TSr2 overlap increases. That is, when the first selective reset pulse TSr1 and the second selective reset pulse TSr2 do not overlap in the same way as the first embodiment, a switching timing must be performed accurately. However, when the first selective reset pulse TSr1 and the second selective reset pulse TSr2 overlap in the same way as the second embodiment, although an error is generated in the accuracy of a switching timing, the discharge generated in the second embodiment is the same as the discharge generated in the first embodiment. Thus, the reliability of a driving circuit for generating the first selective reset pulse TSr1 and the second selective reset pulse TSr2 increases.

Polarity of the first selective reset pulse TSr1, the second selective reset pulse TSr2 and the sustain pulse Sus are equal to one another.

Third Embodiment

Figure 9:
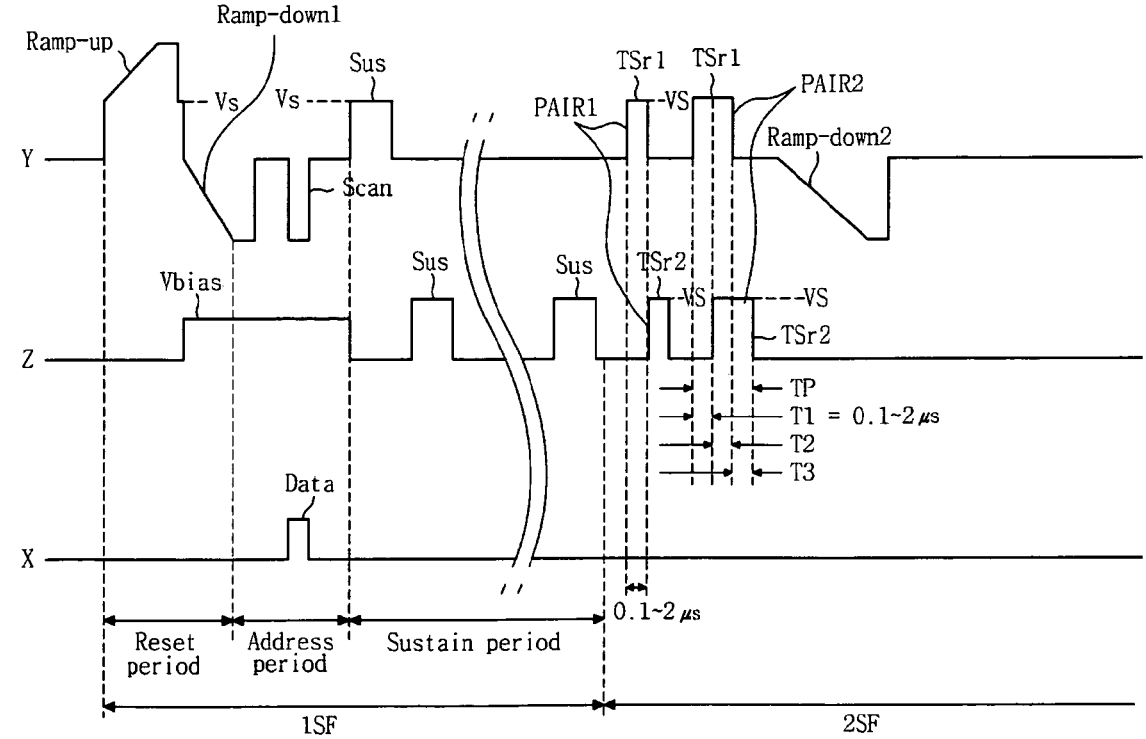
FIG. 9 illustrates a method of driving a plasma display apparatus according to a third embodiment of the present invention.

FIG. 9 illustrates a method of driving a plasma display apparatus according to a third embodiment of the present invention. As shown in FIG. 9, each of a first selective reset pulse TSr1 and a second selective reset pulse TSr2 is supplied plural times. At this time, the first selective reset pulse TSr1 and the second selective reset pulse TSr2 of a first pair of selective reset pulses PAIR1 do not overlap. The first selective reset pulse TSr1 and the second selective reset pulse TSr2 of a second pair of selective reset pulses PAIR2 overlap in a second period T2.

In the third embodiment of the present invention, the first pair of selective reset pulse PAIR1 which do not overlap and the overlapped second pair of selective reset pulses PAIR2 are supplied. However, only the first pair of selective reset pulse PAIR1 which do not overlap may be supplied plural times. Further, only the overlapped second pair of selective reset pulses PAIR2 may be supplied plural times.

Next, the plasma display apparatus according to the embodiments of the present invention will be described in detail with reference to FIGS. 8, 9 and 10.

Figure 10:
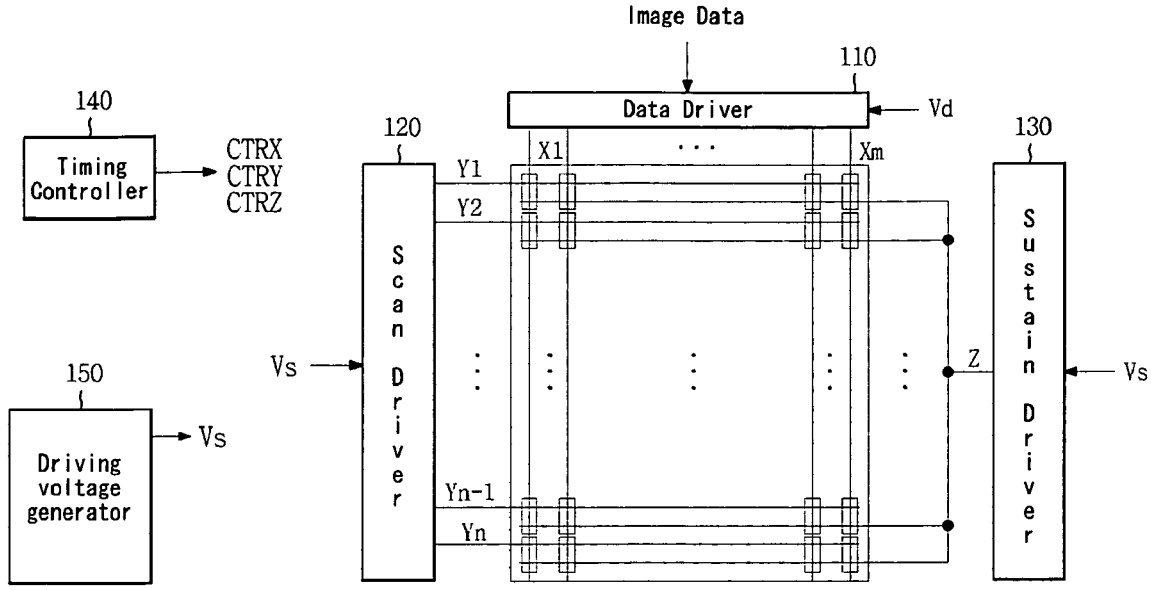
FIG. 10 illustrates the plasma display apparatus according to the embodiments of the present invention.

FIG. 10 illustrates the plasma display apparatus according to the embodiments of the present invention. As shown in FIG. 10, the plasma display apparatus according to the embodiments of the present invention comprises a data driver 110, a scan driver 120, a sustain driver 130, a timing controller 140, a driving voltage generator 150 and a plasma display panel 160. The data driver 110 supplies the address electrodes X1 to Xm a data pulse. The scan driver 120 drives the scan electrodes Y1 to Ym. The sustain driver 130 drives the sustain electrodes Z. The timing controller 140 controls each of the drivers 110, 120 and 130. The driving voltage generator 150 supplies each of the drivers 110, 120 and 130 a driving voltage. The plasma display panel 160 comprises the address electrodes X1 to Xm, the scan electrodes Y1 to Ym and the sustain electrodes Z.

Under the control of the timing controller 140, the data driver 110 supplies the data pulse to the address electrodes X1 to Xm during the address period.

Under the control of the timing controller 140, the scan driver 120 supplies the rising ramp pulse Ramp-up and the falling ramp pulse Ramp-down to the scan electrodes Y1 to Ym during the reset period. Further, the scan driver 120 supplies the scan pulse Scan during the address period and the sustain pulse Sus during the sustain period to the scan electrodes Y1 to Ym.

Under the control of the timing controller 140, the sustain driver 130 supplies the bias voltage Vbias to the sustain electrodes Z during the reset period. Further, the sustain driver 130 supplies the sustain pulse Sus to the sustain electrodes Z during the sustain period.

The scan driver 120 and the sustain driver 130 may supply only the pair of selective reset pulses including the first selective reset pulse TSr1 and the second selective reset pulse TSr2, which do not overlap, one or more times. Further, the scan driver 120 and the sustain driver 130 may supply only the pair of selective reset pulses including the first selective reset pulse TSr1 and the second selective reset pulse TSr2, which overlap to each other in an overlapping period, one or more times. Further, the scan driver 120 and the sustain driver 130 may supply the selective reset pulse pair which do not have an overlapping period and the selective reset pulse pair having an overlapping period. Descriptions of the first selective reset pulse TSr1 and the second selective reset pulse TSr2 were described in detail in the method of driving the plasma display apparatus according to the first to third embodiments of the present invention.

The timing controller 140 controls the data driver 110, the scan driver 120 and the sustain driver 130. The timing controller 140 controls supply timing of the first selective reset pulse TSr1 or the second selective reset pulse TSr2 supplied by the scan driver 120 and the sustain driver 130.

The embodiment of the invention being thus described may be varied in many ways. Such variations are not to be regarded as a departure from the spirit and scope of the invention, and all such modifications as would be obvious to one skilled in the art are intended to be included within the scope of the following claims.

What is claimed is:

1. A method of driving a plasma display apparatus having a scan electrode and a sustain electrode, the method comprising:

applying a ramp-up pulse having a gradually rising voltage to a first electrode during a reset period of a first subfield of a frame, applying, after a last sustain pulse during a sustain period of the first subfield of the frame, a first reset pulse to the first electrode, which is one of the scan electrode and the sustain electrode, during a reset period in a second subfield successive to the first subfield, the first reset pulse having a positive polarity;

applying a second reset pulse to a second electrode, which is the other one of the scan electrode and the sustain electrode, during the reset period in the second subfield, after the application of the first reset pulse, the second reset pulse having a positive polarity; and applying a falling ramp pulse that gradually falls from a ground voltage to a negative voltage to the first electrode after the application of the second reset pulse during the reset period in the second subfield, and wherein each of the first reset pulse and the second reset pulse has a rectangular waveform, each maximum voltage of the first reset pulse and the second reset pulse is equal to a maximum voltage of the last sustain pulse, and each width of the first reset pulse and the second reset pulse is less than a width of the last sustain pulse.

2. The method of claim 1, wherein the first reset pulse and the second reset pulse overlap in some portion of a duration of time of the first reset pulse and the second reset pulse.

3. The method of claim 1, wherein a total period equals a duration of time from an application start time point of the first reset pulse to an application finish time point of the second reset pulse, and the total period comprises a first period, a second period and a third period, wherein the first period equals the duration of time when the first reset pulse and the second reset pulse do not overlap, and during the first period, the second reset pulse is not applied to the second electrode, wherein the second period that follows the first period, equals the duration of time when the first reset pulse and the second reset pulse overlap, and wherein the third period that follows the second period, equals the duration of time when the first reset pulse and the second reset pulse do not overlap, and during the third period, the first reset pulse is not applied to the first electrode.

4. The method of claim 1, wherein a width of the first reset pulse ranges from 0.1 μs to 2 μs.

5. The method of claim 3, wherein the duration of the first period ranges from 0.1 μs to 2 μs.

6. The method of claim 3, wherein the duration of the first period is substantially equal to the duration of the third period.

7. The method of claim 1, wherein the application of the last sustain pulse to the second electrode occurs before the application of the first reset pulse, and magnitudes of peak voltages of the last sustain pulse, the first reset pulse and the second reset pulse are equal to one another.

8. The method of claim 1, wherein each of the first reset pulse and the second reset pulse is applied two or more times.

9. A method of driving a plasma display apparatus having a scan electrode and a sustain electrode, the method comprising:

applying a ramp-up pulse having a gradually rising voltage to a first electrode during a reset period of a first subfield of a frame;

applying a last sustain pulse to the first electrode, which is one of the scan electrode and the sustain electrode, during a sustain period in the first subfield of the frame;

applying a first reset pulse to a second electrode, which is the other one of the scan electrode and the sustain electrode, during a reset period in a second subfield successive to the first subfield, the first reset pulse having a positive polarity;

applying a second reset pulse to the first electrode after the application of the first reset pulse during the reset period in the second subfield, the second reset pulse having a positive polarity, applying a falling ramp pulse to the second electrode after the application of the second reset pulse, wherein a total period equals a duration of time from an application start time point of the first reset pulse to an application finish time point of the second reset pulse, and the total period includes a first period, a second period and a third period, wherein the first period equals the duration of time when the first reset pulse and the second reset pulse do not overlap, and during the first period, the second reset pulse is not applied to the second electrode, wherein the second period that follows the first period equals the duration of time when the first reset pulse and the second reset pulse overlap, wherein the third period that follows the second period equals the duration of time when the first reset pulse and the second reset pulse do not overlap, and during the third period, the first reset pulse is not applied to the first electrode, wherein the falling ramp pulse of the reset period in the second subfield gradually falls from a ground voltage to a negative voltage, and wherein each of the first reset pulse and the second reset pulse has a rectangular waveform, each maximum voltage of the first reset pulse and the second reset pulse is equal to a maximum voltage of a sustain pulse, and each width of the first reset pulse and the second reset pulse is less than a width of the sustain pulse.

10. The method of claim 9, wherein the first reset pulse and the second reset pulse overlap in some portion of a duration of time of the first reset pulse and the second reset pulse.

11. The method of claim 9, wherein a width of the first reset pulse is substantially equal to a width of the second reset pulse.

12. The method of claim 9, wherein a width of the first reset pulse or the second reset pulse ranges from 0.1 μs to 2 μs.

13. The method of claim 9, wherein polarities of peak voltages of the sustain pulse, the first reset pulse and the second reset pulse are equal to one another.

14. The method of claim 9, wherein magnitudes of the peak voltages of the sustain pulse, the first reset pulse and the second reset pulse are equal to one another.

15. The method of claim 1, wherein the falling ramp pulse is applied in the second subfield.

16. The method of claim 1, further comprising applying a falling ramp pulse to the first electrode during a reset period of the first subfield, and a width of the falling ramp pulse of the reset period of the second subfield is larger than a width of the falling ramp pulse of the reset period of the first subfield.

17. The method of claim 9, further comprising applying a falling ramp pulse to the first electrode during a reset period of the first subfield, and a width of the falling ramp pulse of the reset period of the second subfield is larger than a width of the falling ramp pulse of the reset period of the first subfield.

18. A method of driving a plasma display apparatus having a scan electrode and a sustain electrode, the method comprising:

applying a reset pulse including a ramp-up pulse and a first ramp-down pulse to the scan electrode during a reset period of a first subfield of a frame;

applying a scan pulse to the scan electrode during an address period of the first subfield that follows the reset period of the first subfield;

applying a sustain pulse to the scan electrode and the sustain electrode alternately during a sustain period of the first subfield that follows the address period of the first subfield;

applying, after a last sustain pulse supplied to the sustain electrode during the sustain period of the first subfield, a first reset pulse to the scan electrode during a reset period of a second subfield next to the first subfield of the frame, wherein the first reset pulse having a positive polarity;

applying a second reset pulse to the sustain electrode during the reset period of the second subfield of the frame, after application of the first reset pulse, wherein the second reset pulse having a positive polarity; and applying a second ramp-down pulse to the scan electrode, after application of the second reset pulse, wherein a width of the first reset pulse and the second reset pulse is less than a width of the sustain pulse, and wherein each of the first reset pulse and the second reset pulse has a rectangular waveform, each maximum voltage of the first reset pulse and the second reset pulse is equal to a maximum voltage of the sustain pulse.

19. The method of claim 18, wherein an amount of a wall charges in a discharge cell is decreased by a discharge generated by the second reset pulse.

20. A method of driving a plasma display apparatus having a scan electrode and a sustain electrode, the method comprising:

applying a reset pulse including a ramp-up pulse and a first ramp-down pulse to the scan electrode during a reset period of a first subfield of a frame;

applying a scan pulse to the scan electrode during an address period of the first subfield that follows the reset period of the first subfield;

applying a sustain pulse to the scan electrode and the sustain electrode alternately during a sustain period follows the address period of the first subfield;

applying, after a last sustain pulse supplied to the sustain electrode during the sustain period of the first subfield, a first reset pulse to the scan electrode during a reset period of a second subfield next to the first subfield of the frame, wherein the first reset pulse having a positive polarity;

applying a second reset pulse to the sustain electrode during the reset period of the second subfield of the frame, after application of the first reset pulse, wherein the second reset pulse having a positive polarity;

applying a third reset pulse to the scan electrode during the reset period of the second subfield of the frame, after application of the second reset pulse, wherein the third reset pulse having a positive polarity;

applying a fourth reset pulse to the sustain electrode during the reset period of the second subfield of the frame, after application of the third reset pulse, wherein the fourth reset pulse having a positive polarity; and applying a second ramp-down pulse to the scan electrode, after application of the fourth reset pulse, wherein a width of the first reset pulse and the second reset pulse is less than a width of the sustain pulse, and a width of the third reset pulse and the fourth reset pulse is greater than the width of the first reset pulse and the second reset pulse, and wherein each of the first reset pulse and the second reset pulse has a rectangular waveform, each maximum voltage of the first reset pulse and the second reset pulse is equal to a maximum voltage of the sustain pulse.

* * * * *